US008544229B2

(12) United States Patent
Kilgore et al.

(10) Patent No.: US 8,544,229 B2
(45) Date of Patent: Oct. 1, 2013

(54) DECKING SYSTEM WITH HIDDEN DOVETAIL FASTENER

(75) Inventors: Dorian Kilgore, Southfield, MI (US); William Teller, Lake Orion, MI (US)

(73) Assignee: A. Raymond et Cie, Grenoble (FR)

( * ) Notice: Subject to any disclaimer, the term of this patent is extended or adjusted under 35 U.S.C. 154(b) by 0 days.

(21) Appl. No.: 13/548,330

(22) Filed: Jul. 13, 2012

(65) Prior Publication Data

US 2013/0025228 A1 Jan. 31, 2013

Related U.S. Application Data

(60) Provisional application No. 61/507,177, filed on Jul. 13, 2011.

(51) Int. Cl.
*E04B 1/38* (2006.01)
*E04B 5/12* (2006.01)
*E04F 15/00* (2006.01)

(52) U.S. Cl.
USPC ..... 52/489.2; 52/177; 52/550; 52/715; 52/745.21; D8/382

(58) Field of Classification Search
USPC ..... 52/177, 489.1, 489.2, 550, 712, 715, 52/745.21; D8/382, 389; 411/461, 463, 411/466; 24/289, 292–295; 403/252, 255, 403/397
See application file for complete search history.

(56) References Cited

U.S. PATENT DOCUMENTS

| | | | | | |
|---|---|---|---|---|---|
| 1,848,085 | A | * | 3/1932 | Eisenschmidt | 403/187 |
| 2,282,624 | A | * | 5/1942 | Upson et al. | 411/466 |
| 3,020,602 | A | * | 2/1962 | Siering | 52/714 |
| 3,208,119 | A | * | 9/1965 | Seckerson | 52/716.6 |
| 3,714,747 | A | * | 2/1973 | Curran | 52/309.2 |
| 4,033,083 | A | * | 7/1977 | Fritz et al. | 52/489.1 |
| 4,141,191 | A | * | 2/1979 | Aarons | 52/715 |
| D260,481 | S | * | 9/1981 | Norcross et al. | D8/394 |
| 4,546,587 | A | * | 10/1985 | Mosch | 52/506.08 |
| 4,777,778 | A | * | 10/1988 | Taupin | 52/714 |
| 5,997,209 | A | * | 12/1999 | Sachs | 403/388 |
| 6,301,842 | B1 | * | 10/2001 | Chaney et al. | 52/177 |
| 6,871,467 | B2 | * | 3/2005 | Hafner | 52/586.1 |
| D523,735 | S | * | 6/2006 | Craine | D8/354 |
| 7,971,410 | B2 | * | 7/2011 | Jerke | 52/702 |
| 8,146,303 | B2 | * | 4/2012 | Gibson et al. | 52/177 |
| D659,522 | S | * | 5/2012 | Noturno | D8/382 |
| D674,684 | S | * | 1/2013 | Noturno | D8/382 |
| 2002/0056238 | A1 | * | 5/2002 | Leines | 52/177 |
| 2009/0223027 | A1 | * | 9/2009 | Reznar et al. | 24/457 |
| 2013/0014465 | A1 | * | 1/2013 | Kilgore et al. | 52/650.3 |

FOREIGN PATENT DOCUMENTS

WO 2009/099664 A1 * 8/2009

* cited by examiner

*Primary Examiner* — Robert Canfield
(74) *Attorney, Agent, or Firm* — McDonald Hopkins LLC

(57) ABSTRACT

This present invention relates generally to deck fasteners for securing deck boards together and to a supporting member, and more particularly with a deck fastener which does not protrude from the deck surface.

30 Claims, 4 Drawing Sheets

DECKING SYSTEM WITH HIDDEN DOVETAIL FASTENER

CROSS-REFERENCE TO RELATED APPLICATION

This application claims the benefit of U.S. Provisional Patent Application No. 61/507,177, entitled "Decking System with Hidden Dovetail Fastener," filed on Jul. 13, 2011, which is hereby incorporated in its entirety by reference.

FIELD OF ART

This invention relates generally to deck fasteners for securing deck boards together and to a supporting member, and more particularly with a deck fastener which does not protrude from the deck surface.

BACKGROUND OF THE INVENTION

In decking and frame construction, it is often desirable to provide a blind or invisible interconnection between the decking boards and the underlying supporting joists. This desire is accentuated with decking that is exposed to the open environment as the exposed connectors may be susceptible to oxidation, leaching and similar environmental affects. Various connectors and decking designs have been proposed to resolve this issue. Though some designs have successfully decreased the aforementioned problems, issues still remain with hidden fastening of decking.

Decking systems commonly include a series of joists supported by a frame. The joists are aligned parallel to one another. Decking boards are connected to the joists and spaced adjacent to one another. Often, a gap is left between the decking boards to allow space for expansion and contraction of the system, specifically expansion and contraction of the decking boards, without damaging the system.

Decking fasteners are used to connect the decking boards to the joists and to one another. Decking boards are commonly mounted perpendicular to the joists such that each decking board is supported by multiple joists. A decking fastener may connect to both the joist and the decking board to prevent the decking board from moving with respect to the joists. Often, fasteners are mounted at the edge of a decking board and further connect to the adjacent decking board. Thus, a single fastener may fix a decking board to both a joist and an adjacent decking board.

Hidden decking fasteners are used to hide the fastener beneath the surface of the decking board and away from harsh environmental elements. However, as many decking designs include a space between the decking boards, many hidden fasteners are still visible from above and are still susceptible to environmental elements. Additionally, many decking fasteners require the use of nails, screws, bolts, and other extraneous hardware to connect the fasteners to the joists. This hardware complicates assembly of the deck. Therefore, an improved decking system is needed to cure these and other design defects.

SUMMARY OF THE INVENTION

This invention relates generally to deck fasteners for securing deck boards together and to a supporting member, and more particularly with a deck fastener which does not protrude from the deck surface.

In one embodiment, the present invention relates to a decking fastener comprising: a first joist connector, the first joist connector having a first side edge, a second side edge, a bottom edge and a top edge, the first and second side edges being opposite one another, wherein each of the first and second side edges has at least one anchoring tabs formed therein; a second joist connector, the second joist connector having a first side edge, a second side edge, a bottom edge and a top edge, the first and second side edges being opposite one another, wherein each of the first and second side edges has at least one anchoring tabs formed therein; and a board connector, the board connector having a first side, a second side and a bottom, wherein the first side and the second side of the board connector are operatively coupled to opposite sides of the bottom and are arranged in a substantially parallel manner to one another, wherein the remaining sides of the bottom of the board connector are operatively coupled to at least a portion of the top edges of the first and second joist connectors so that the first and second joist connectors are arranged in a substantially perpendicular manner to the first and second board connector sides.

In another embodiment, the present invention relates to a decking system comprising: a frame; at least one joist, the at least one joist being secured to the frame; at least one decking board, the at least one decking board having a top side and a bottom side, the bottom side having formed therein at least one slotted opening, wherein the at least one decking board is secured to the at least one joist via at least one decking fastener, the decking fastener comprising: a first joist connector, the first joist connector having a first side edge, a second side edge, a bottom edge and a top edge, the first and second side edges being opposite one another, wherein each of the first and second side edges has at least one anchoring tabs formed therein; a second joist connector, the second joist connector having a first side edge, a second side edge, a bottom edge and a top edge, the first and second side edges being opposite one another, wherein each of the first and second side edges has at least one anchoring tabs formed therein; and a board connector, the board connector having a first side, a second side and a bottom, wherein the first side and the second side of the board connector are operatively coupled to opposite sides of the bottom and are arranged in a substantially parallel manner to one another and wherein the board connector is designed to operatively engage the slotted opening in the bottom of the at least one decking board, wherein the remaining sides of the bottom of the board connector are operatively coupled to at least a portion of the top edges of the first and second joist connectors so that the first and second joist connectors are arranged in a substantially perpendicular manner to the first and second board connector sides.

In still another embodiment, the present invention relates to a method of assembling a decking system comprising the steps of: forming a frame; securing at least one joist to at least a portion of the frame; securing at least one decking board to at least a portion of the at least one joist via at least one decking fastener, the at least one decking board having a top side and a bottom side, the bottom side having formed therein at least one slotted opening, the decking fastener comprising: a first joist connector, the first joist connector having a first side edge, a second side edge, a bottom edge and a top edge, the first and second side edges being opposite one another, wherein each of the first and second side edges has at least one anchoring tabs formed therein; a second joist connector, the second joist connector having a first side edge, a second side edge, a bottom edge and a top edge, the first and second side edges being opposite one another, wherein each of the first and second side edges has at least one anchoring tabs formed therein; and a board connector, the board connector having a first side, a second side and a bottom, wherein the first side and the second side of the board connector are operatively coupled to opposite sides of the bottom and are arranged in a substantially parallel manner to one another and wherein the board connector is designed to operatively engage the slotted opening in the bottom of the at least one decking board, wherein the remaining sides of the bottom of the board connector are operatively coupled to at least a portion of the top edges of the first and second joist connectors so that the first and second joist connectors are arranged in a substantially perpendicular manner to the first and second board connector sides.

DESCRIPTION OF THE DRAWINGS

The operation of the invention may be better understood by reference to the following detailed description taken in connection with the following illustrations, wherein.

DETAILED DESCRIPTION OF THE INVENTION

Figure 2:
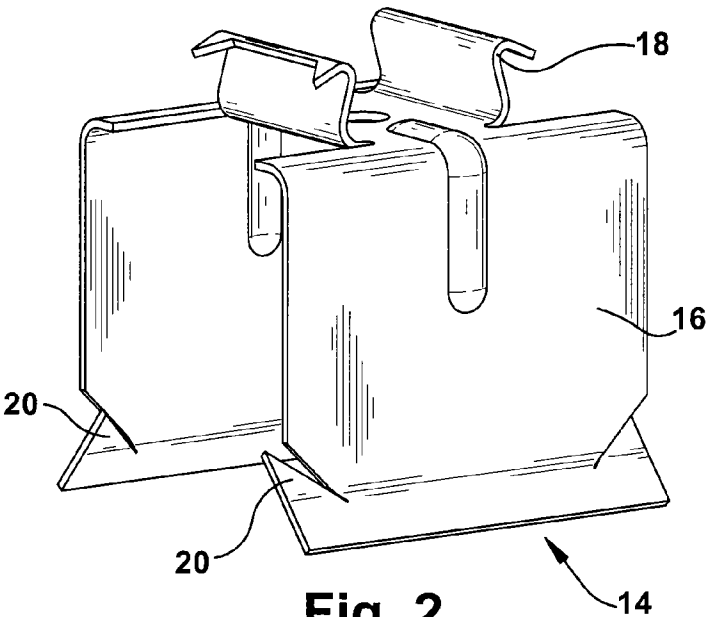
FIG. 2 is a perspective view of an embodiment of a hidden fastener of the hidden decking system.

Reference will now be made in detail to exemplary embodiments of the present invention, examples of which are illustrated in the accompanying drawings. It is to be understood that other embodiments may be utilized and structural and functional changes may be made without departing from the respective scope of the invention. As such, the following description is presented by way of illustration only and should not limit in any way the various alternatives and modifications that may be made to the illustrated embodiments and still be within the spirit and scope of the invention.

With reference to FIGS. 1 through 9, an improved decking system 10 having a hidden fastener 14 is provided. The decking system 10 may be free-standing or connected to a structure on one or more sides. The decking system 10 may be generally supported by a frame (not shown). The frame may include a plurality of posts and cross-beams configured to provide a base structure for the decking system 10.

The decking system 10 includes a series of joists—one of which is shown as 11—supported by the frame. The joists 11 may be arranged parallel to each other to provide a support grid for a plurality of decking boards 12. Alternatively, the joists 11 may be arranged in any configuration to support the decking boards 12. The decking boards 12 may be located perpendicular to the joists 11 such that each decking board 12 is supported by multiple joists 11. Alternatively, the decking boards 12 may be arranged parallel to the joists 11 or at an angle with respect to the joists 11.

Figure 1:
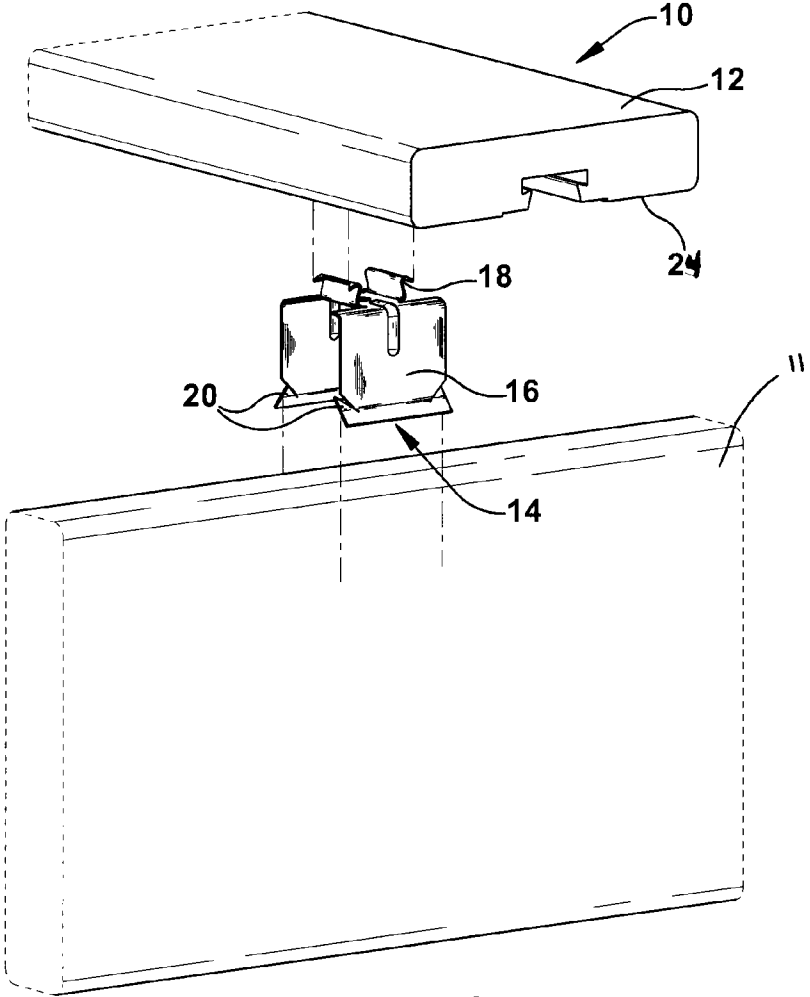
FIG. 1 is a perspective view of a decking system having a hidden decking fastener in an embodiment of the invention.
Figure 3:
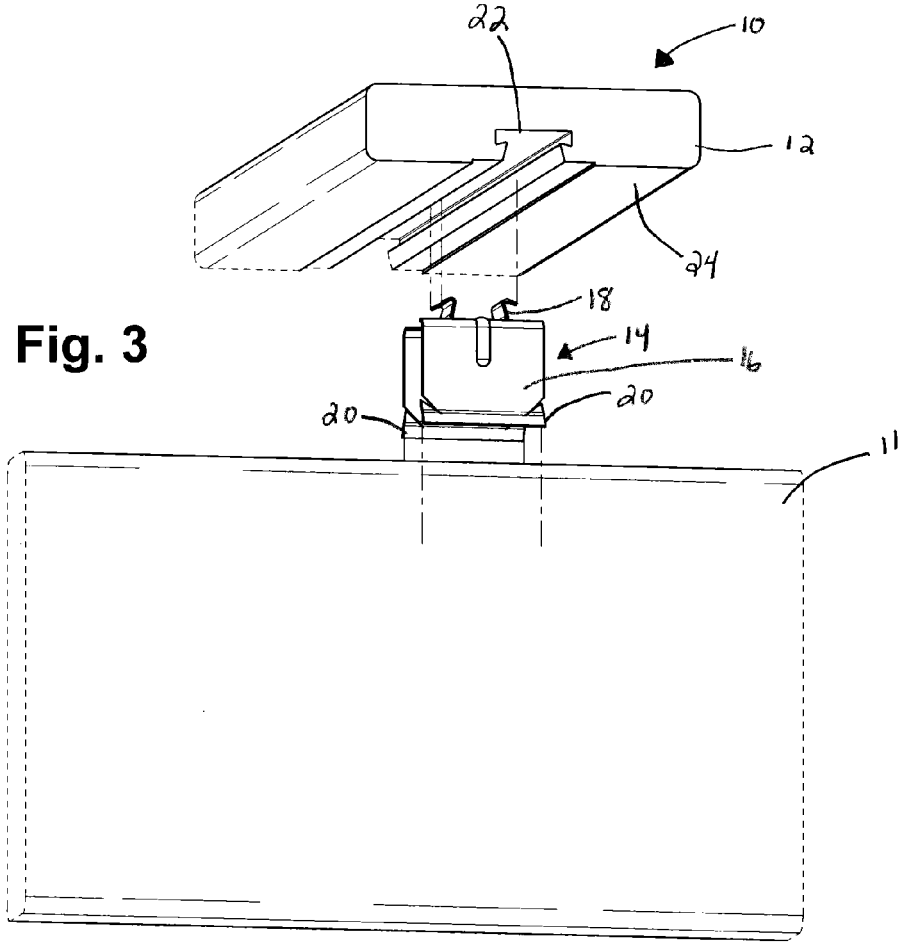
FIG. 3 is a perspective view of an embodiment of the hidden decking system with the hidden fastener not attached.

The decking system 10 may include a fastener 14 to interconnect the decking boards 12 to the joists 11. The fastener 14 may be of any material such as a metal, a metal alloy, etc. In one embodiment, fastener 14 is formed from titanium, aluminum, stainless steel, or hardened steel (e.g., 1050 or 1056 steel). The fastener 14 may comprise a joist connector 16 and a board connector 18. The joist connector 16 may be configured to engage a portion of the joist 11. For example, as illustrated in FIG. 1, the joist connector 16 may be a substantially u-shaped clamp that is sized and shaped to engage an edge of a joist 11. Although a u-shaped clamp is shown, it should be understood that the present invention is not limited to such and may comprise additional shapes. The clamp portion of the joist connector 16 may be tapered to hold the joist 11 in a frictional fit. The joist connector 16 may be fixed to the joist 11 by aligning the opening of the u-shaped clamp with an edge of the joist 11 and applying a force thereto.

The joist connector 16 may further include a secondary feature to prevent the fastener 14 from sliding relative to the joist 11. For example, as shown in FIGS. 2, 7-9, the joist connector 16 may include tabs 20 that may be hammered or driven into the joist 11 to further secure the fastener 14 thereto. While the fastener 14 is described herein as being connected to the joist 11 without any additional hardware, it will be appreciated that the nails, screws, bolts or any other hardware known in the art may be used to further secure the fastener 14 to the joist 11. In this embodiment, the tabs 20 may further help prevent the decking boards 12 from coming loose from the joists 11, especially during windy conditions. The tabs 20 can add additional security of the fasteners 14 into the joists 11.

Figure 9:
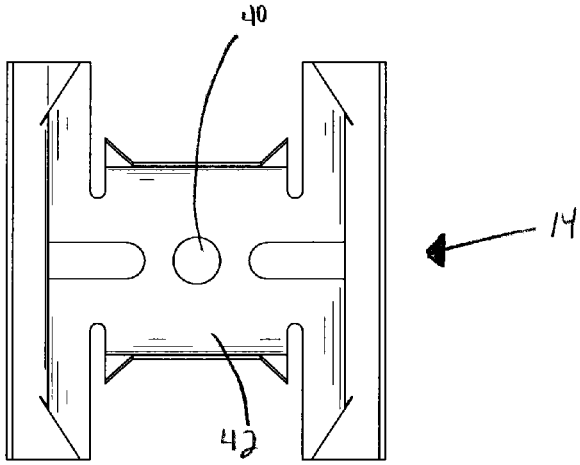
FIG. 9 is a top view of an embodiment of the hidden fastener.

In an alternative embodiment, shown in FIG. 9, the fasteners 14 may include an aperture 40 on the top surface 42 of the fastener 14. The aperture 40 can be sized and shaped to receive a fastening device (not shown), such as a screw, nail or the like. In this embodiment, the fastener 14 can be positioned in the opening 22. Then the fastening device can be inserted into the aperture 40 with the stop surface 42 resting in the opening 22 of the decking boards 12 and fastened to the decking boards 12. This permits an installer to attach the fasteners 12 to the opening 22 in the decking boards to aid in installation of the decking system 10.

The decking system 10 may be configured to hide the fasteners 14 from above and shelter them from exposure to environmental elements. Traditional decking systems include decking boards that are arranged with spaces therebetween to allow for expansion and contraction of the decking boards. The fasteners are often positioned between the decking boards to interconnect the decking boards and the joists. However, the space between the decking boards allows for the fasteners to be seen from above and exposed to environmental elements.

To hide the fasteners 14, the decking boards 12 may be configured to completely cover the fasteners 14. As shown in FIGS. 1, 3-6, the underside 24 of the decking boards 12 may include an opening 22 to receive the board connector 18. The opening 22 may be a channel configured to hold the board connector 18 therein. In an embodiment, the opening 22 is an extruded portion having a negative angle, such as a dovetail shaped extrusion. The board connector 18 is similarly shaped and capable of being slid or snapped into the opening 22. The negative angle or features of the opening 22 will retain the board connector within the opening. While the opening 22 is shown and described as being dovetail shaped, it will be appreciated that the opening 22 and board connector 18 may be of any shape and size that allows the fastener 14 to be retained by within the opening 22.

Each decking board 12 may include a plurality of openings 22 to receive multiple fasteners 14. The openings 22 may be perpendicular to the length of the decking board 12 such that the fasteners 14 are space apart along the length of the decking board 12 to align with the joists 11. Alternatively, the decking board 12 may include a single extruded opening 22 along its length. Multiple fasteners 14 may be inserted into the opening 22 and spaced apart so as to align with the joists 11. As illustrated in FIGS. 1, 3-6, the opening may be centrally located on an underside 24 of the decking board 12 such that the decking board 12 completely covers the fastener 14, thereby hiding the fastener from view above and sheltering it from the environment.

Figure 4:
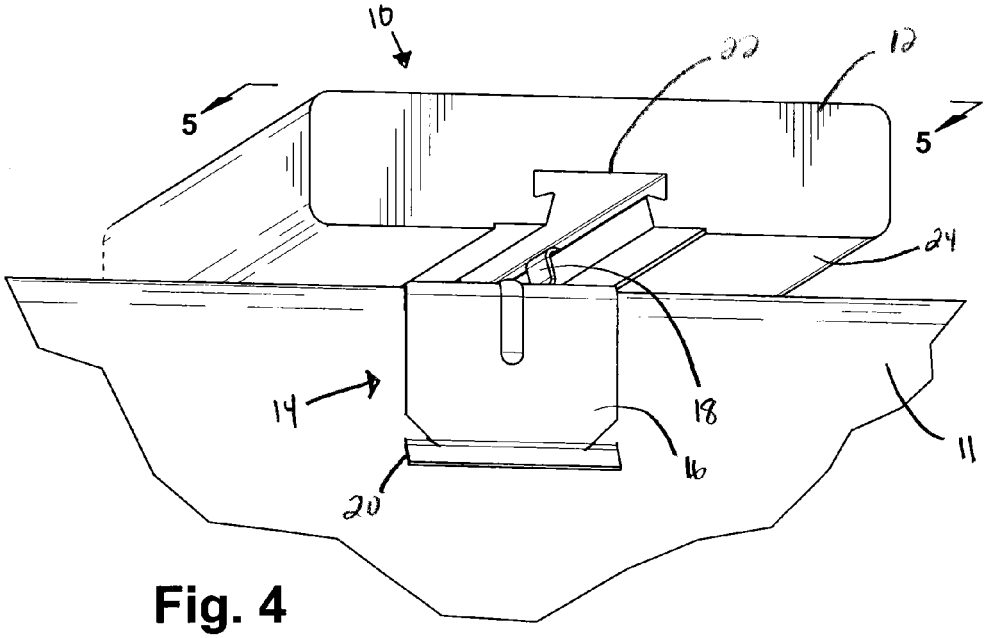
FIG. 4 is a perspective view of an embodiment of the hidden decking system with the hidden fastener attached.
Figure 5:
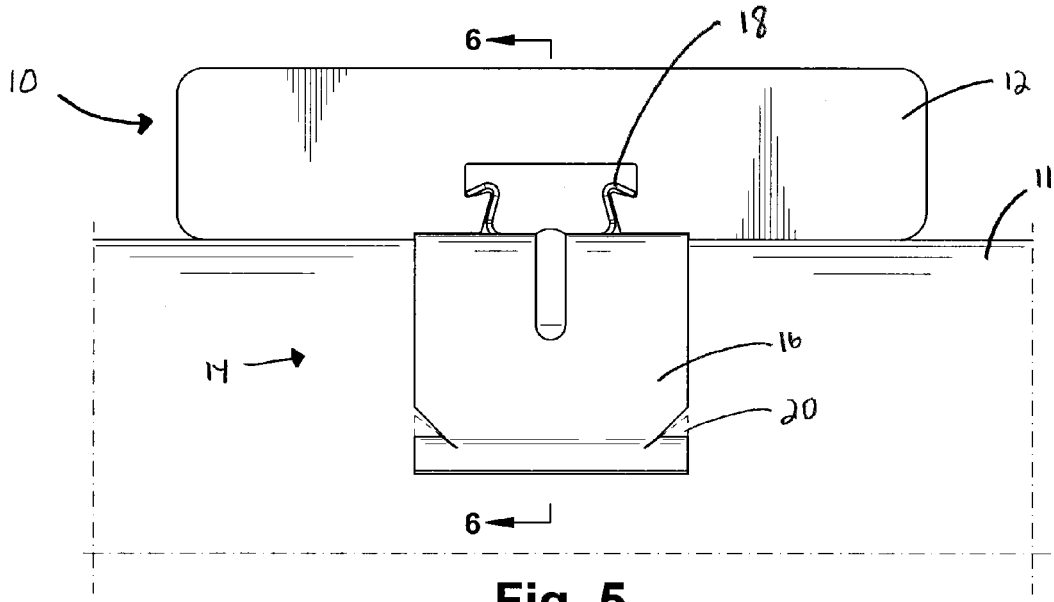
FIG. 5 is a view taken along lines 5-5 of FIG. 4 of the hidden decking system of the present invention with the hidden fastener installed.
Figure 6:
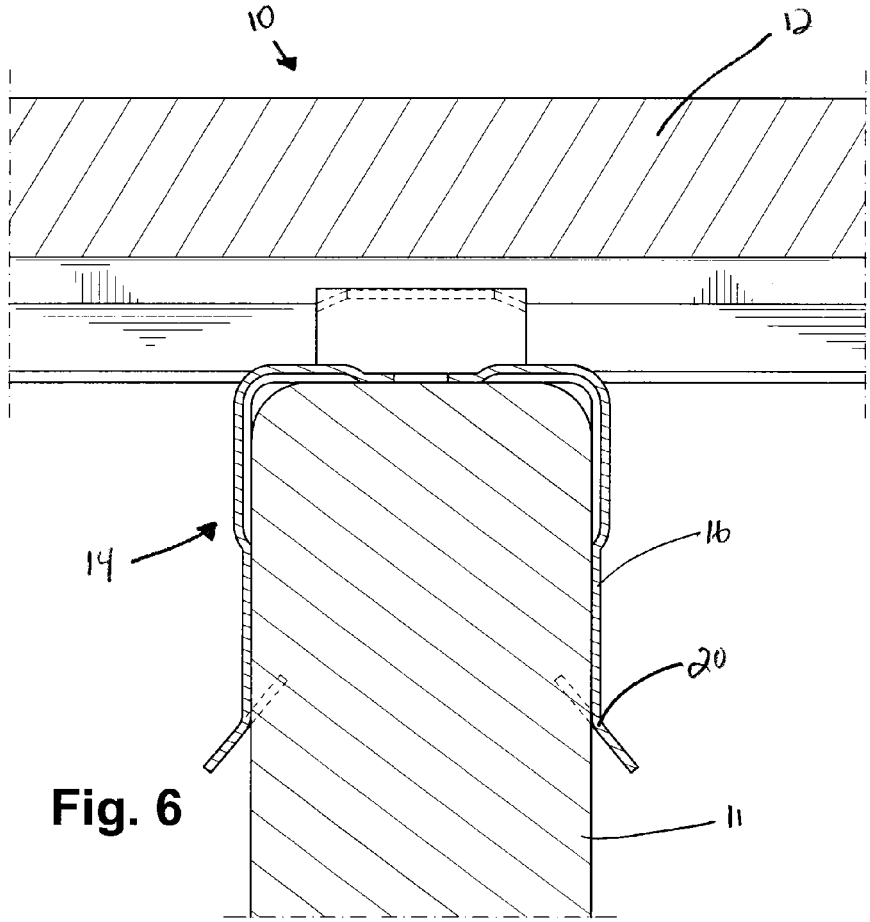
FIG. 6 is a view taken along lines 6-6 of FIG. 5 of the hidden decking system of the present invention with the hidden fastener installed.
Figure 7:
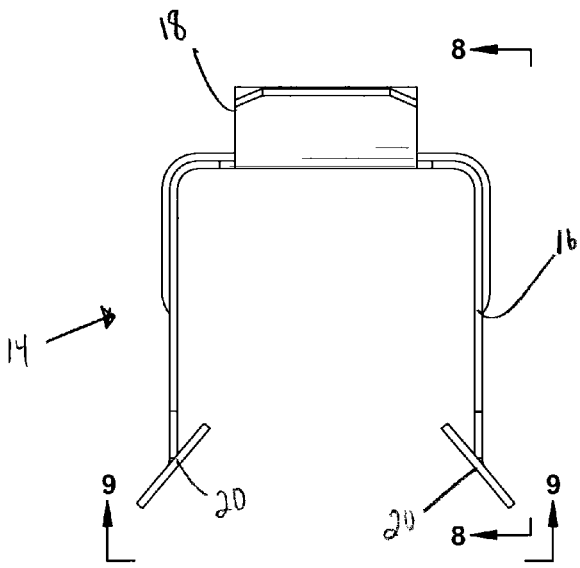
FIG. 7 is a front view of an embodiment of the hidden fastener.
Figure 8:
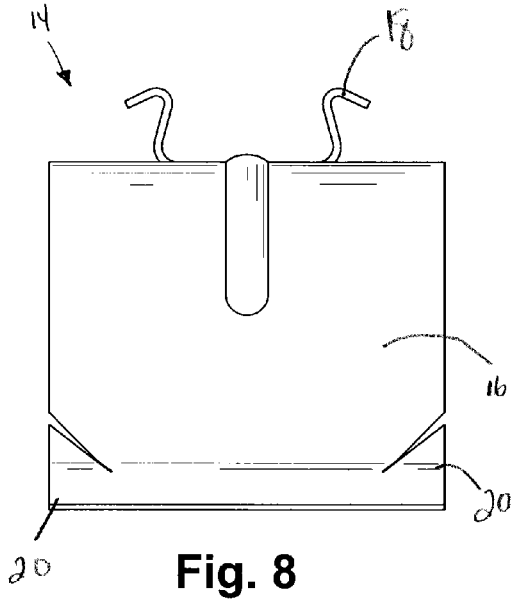
FIG. 8 is a side view of an embodiment of the hidden fastener.

In use, a plurality of fasteners 14 is connected to a decking board 12. The fasteners 14 are inserted into an extruded opening 22 on the underside 24 of the decking board 12 and arranged so as to be hidden under the decking board. The fasteners 14 are arranged to align with and engage the joists 11. The opening of each u-shaped joist connector 16 is placed over a portion of the corresponding joist 11, and a force is applied to the decking board 12 above each fastener 14. The tabs 20 may be hammered or driven into the joist 11 to prevent the fastener 14 from sliding or moving with respect to the joist 11. Alternatively, the fasteners 14 may be attached to the underside 24 of the decking board 12 as shown in FIGS. 4-6. Once the fasteners 14 are attached, the decking board 12 may be placed on top of the joists 11 and then stepped on to drive the decking board 12 onto the joists 11. This provides a system that is not difficult to install.

The decking system 10 may provide a secure fit between the decking boards 12 and the joists 11. More specifically, many of the prior art decking systems, especially those that purport to be hidden fastener systems, do not provide sufficient updraft strength. The attachment of the decking boards to the joists is not strong enough to prevent the deck boards from lifting during heavy wind conditions. The fastener 14 of the present embodiment provides a strong connection between the decking boards 12 and the joists 11. The present embodiment may resist a predetermined amount of updraft to help prevent the deck boards 12 from lifting from the joists 11 during windy conditions.

While the present embodiment shows the decking boards 12 being perpendicular to the joists 11, the decking boards 12 may use the decking system 10 and have the decking boards 12 installed at 45 degree angles with respect to the joists 11. Additionally, the joists 11 may be installed such that the decking boards 12 may be installed perpendicular thereto while being installed 45 degrees relative to a structure against which the decking system 10 is installed.

Although the embodiments of the present invention have been illustrated in the accompanying drawings and described in the foregoing detailed description, it is to be understood that the present invention is not to be limited to just the embodiments disclosed, but that the invention described herein is capable of numerous rearrangements, modifications and substitutions without departing from the scope of the claims hereafter. The claims as follows are intended to include all modifications and alterations insofar as they come within the scope of the claims or the equivalent thereof.

Having thus described the invention, we claim:

1. A decking fastener comprising:

a first joist connector, the first joist connector having a first side edge, a second side edge, a bottom edge and a top edge, the first and second side edges being opposite one another, wherein each of the first and second side edges has at least one anchoring tab formed therein;

a second joist connector, the second joist connector having a first side edge, a second side edge, a bottom edge and a top edge, the first and second side edges being opposite one another, wherein each of the first and second side edges has at least one anchoring tab formed therein; and a board connector, the board connector having a first side, a second side and a bottom, wherein the first side and the second side of the board connector are operatively coupled to opposite sides of the bottom and are arranged in a substantially parallel manner to one another, wherein the remaining sides of the bottom of the board connector are operatively coupled to at least a portion of the top edges of the first and second joist connectors so that the first and second joist connectors are arranged in a substantially perpendicular manner to the first and second board connector sides.

2. The decking fastener of claim 1, wherein each of the first and second sides of the board connector have curved top edges so as to form first and second slightly downwardly curved flanges.

3. The decking fastener of claim 2, wherein first and second slightly downwardly curved flanges further comprise at least one tooth formed therein.

4. The decking fastener of claim 3, wherein the at least one tooth is triangular-shaped.

5. The decking fastener of claim 2, wherein first and second slightly downwardly curved flanges further comprise at least two teeth formed therein.

6. The decking fastener of claim 5, wherein the at least two teeth are each triangular-shaped.

7. The decking fastener of claim 1, wherein the each of the first and second side edges have at least two anchoring tabs formed therein.

8. The decking fastener of claim 1, wherein the first and second joist connectors and the first and second sides of the board connector form two perpendicularly transposed U-shaped components of the decking fastener.

9. The decking fastener of claim 1, wherein the decking fastener is formed from titanium, aluminum, stainless steel, or hardened steel.

10. The decking fastener of claim 1, wherein the bottom of the board connector further comprises at least one aperture formed therein.

11. A decking system comprising:

a frame;

at least one joist, the at least one joist being secured to the frame;

at least one decking board, the at least one decking board having a top side and a bottom side, the bottom side having formed therein at least one slotted opening, wherein the at least one decking board is secured to the at least one joist via at least one decking fastener, the decking fastener comprising:

a first joist connector, the first joist connector having a first side edge, a second side edge, a bottom edge and a top edge, the first and second side edges being opposite one another, wherein each of the first and second side edges has at least one anchoring tabs formed therein;

a second joist connector, the second joist connector having a first side edge, a second side edge, a bottom edge and a top edge, the first and second side edges being opposite one another, wherein each of the first and second side edges has at least one anchoring tabs formed therein; and a board connector, the board connector having a first side, a second side and a bottom, wherein the first side and the second side of the board connector are operatively coupled to opposite sides of the bottom and are arranged in a substantially parallel manner to one another and wherein the board connector is designed to operatively engage the slotted opening in the bottom of the at least one decking board, wherein the remaining sides of the bottom of the board connector are operatively coupled to at least a portion of the top edges of the first and second joist connectors so that the first and second joist connectors are arranged in a substantially perpendicular manner to the first and second board connector sides.

12. The decking system of claim 11, wherein each of the first and second sides of the board connector have curved top edges so as to form first and second slightly downwardly curved flanges.

13. The decking system of claim 12, wherein first and second slightly downwardly curved flanges further comprise at least one tooth formed therein.

14. The decking system of claim 13, wherein the at least one tooth is triangular-shaped.

15. The decking system of claim 12, wherein first and second slightly downwardly curved flanges further comprise at least two teeth formed therein.

16. The decking system of claim 15, wherein the at least two teeth are each triangular-shaped.

17. The decking system of claim 11, wherein the each of the first and second side edges have at least two anchoring tabs formed therein.

18. The decking system of claim 11, wherein the first and second joist connectors and the first and second sides of the board connector form two perpendicularly transposed U-shaped components of the decking fastener.

19. The decking system of claim 11, wherein the decking fastener is formed from titanium, aluminum, stainless steel, or hardened steel.

20. The decking system of claim 11, wherein the bottom of the board connector further comprises at least one aperture formed therein.

21. A method of assembling a decking system comprising the steps of:

forming a frame;

securing at least one joist to at least a portion of the frame;

securing at least one decking board to at least a portion of the at least one joist via at least one decking fastener, the at least one decking board having a top side and a bottom side, the bottom side having formed therein at least one slotted opening, the decking fastener comprising:

a first joist connector, the first joist connector having a first side edge, a second side edge, a bottom edge and a top edge, the first and second side edges being opposite one another, wherein each of the first and second side edges has at least one anchoring tabs formed therein;

a second joist connector, the second joist connector having a first side edge, a second side edge, a bottom edge and a top edge, the first and second side edges being opposite one another, wherein each of the first and second side edges has at least one anchoring tabs formed therein; and a board connector, the board connector having a first side, a second side and a bottom, wherein the first side and the second side of the board connector are operatively coupled to opposite sides of the bottom and are arranged in a substantially parallel manner to one another and wherein the board connector is designed to operatively engage the slotted opening in the bottom of the at least one decking board, wherein the remaining sides of the bottom of the board connector are operatively coupled to at least a portion of the top edges of the first and second joist connectors so that the first and second joist connectors are arranged in a substantially perpendicular manner to the first and second board connector sides.

22. The method of claim 21, wherein each of the first and second sides of the board connector have curved top edges so as to form first and second slightly downwardly curved flanges.

23. The method of claim 22, wherein first and second slightly downwardly curved flanges further comprise at least one tooth formed therein.

24. The method of claim 23, wherein the at least one tooth is triangular-shaped.

25. The method of claim 22, wherein first and second slightly downwardly curved flanges further comprise at least two teeth formed therein.

26. The method of claim 25, wherein the at least two teeth are each triangular-shaped.

27. The method of claim 21, wherein the each of the first and second side edges have at least two anchoring tabs formed therein.

28. The method of claim 21, wherein the first and second joist connectors and the first and second sides of the board connector form two perpendicularly transposed U-shaped components of the decking fastener.

29. The method of claim 21, wherein the decking fastener is formed from titanium, aluminum, stainless steel, or hardened steel.

30. The method of claim 21, wherein the bottom of the board connector further comprises at least one aperture formed therein.

* * * * *